US006199264B1

(12) United States Patent
Marcou et al.

(10) Patent No.: US 6,199,264 B1
(45) **Date of Patent: *Mar. 13, 2001**

(54) METHOD OF ASSEMBLING A GROUND FAULT INTERRUPTER WIRING DEVICE

(75) Inventors: Jean-Claude Marcou, DeWitt; Thomas N. Packard, Syracuse; James K. Findley, Manlius; David A. Finlay, Marietta; Patrick J. Murphy, Marcellus, all of NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/328,089

(22) Filed: Oct. 24, 1994

(51) Int. Cl.[7] ..... H04R 31/00; H01H 11/00
(52) U.S. Cl. ..... 29/593; 29/622
(58) Field of Search ..... 361/45; 29/622, 29/593, 434

(56) References Cited

U.S. PATENT DOCUMENTS 3,789,268 * 1/1974 Klein ..... 29/593
4,667,263 * 5/1987 Morris et al. ..... 361/45
4,686,600 * 8/1987 Morris et al. ..... 361/45
4,872,081 * 10/1989 Murphy et al. ..... 361/641
4,872,087 * 10/1989 Brant ..... 361/45

* cited by examiner

*Primary Examiner*—P. W. Echols
(74) *Attorney, Agent, or Firm*—Harter, Secrest & Emery LLP; Stephen B. Salai

(57) ABSTRACT

A gfi wiring device is disclosed in the form of a duplex receptacle for receiving the blades of a plug connecting an electrical appliance or other load to the circuit wherein the gfi device is connected. The housing sections and components of the gfi are so configured and relatively arranged that the device may be automatically assembled by downward, vertical movement of the components and the front housing section in a predetermined sequence relative to the rear housing section as the latter is positioned on a horizontal support. The device is operationally tested after assembly is complete and, upon successful testing, the housing sections are permanently connected by heat deformation of portions of one section to form a rivet-like connection. Reliability of testing is improved by breaking the usual traces on a printed circuit board extending between terminals to which jumper cables are connected to provide a fail-safe indication of circuit continuity through the jumper cables. A deformable member movable to produce a fault condition for test purposes, as well as electrical leads of a condition-indicating lamp are connected in the circuitry by solderless means, being engaged between edge portions of terminal members and a separator member of dielectric material.

12 Claims, 14 Drawing Sheets

METHOD OF ASSEMBLING A GROUND FAULT INTERRUPTER WIRING DEVICE

BACKGROUND OF THE INVENTION

The present invention relates to the class of electrical wiring devices known as ground fault interrupter (gfi) receptacles and, more specifically, to novel gfi receptacles suited for fully automated assembly, and to novel means for and methods of assembling and testing gfi receptacles.

Receptacles with circuit interrupting capability have come into wide-spread use in recent years, resulting in concerted efforts to reduce the cost of parts and labor required for their assembly while maintaining a high degree of operational reliability. Automated assembly techniques are widely used today to reduce labor costs, but at least some operations are still performed manually in virtually all commercially produced gfi receptacles.

Certain tests are performed upon gfi receptacles after complete assembly to ensure proper in-service operation. Some gfi receptacles have two or more housing sections which are mutually assembled by releasable connecting means and, following successful testing, are permanently connected, e.g., by heat fusion of opposing surfaces. Permanent connection of the plastic housing sections by mechanical means such as riveting, while providing certain advantages, add to assembly costs and are not generally employed in present-day gfi receptacles. Furthermore, in a currently conventional manner of fabrication of gfi receptacles, certain of the tests performed may not be entirely reliable for the intended purpose.

It is a principal object of the present invention to provide a gfi receptacle of novel design conducive to fully automated assembly.

Another object is to provide a novel, fully automated method of assembly of a gfi receptacle.

A further object is to provide a gfi receptacle having features which permit testing after complete assembly of all component parts, followed by either permanent assembly in a novel manner upon successful testing, or disassembly without damage to any components upon unsuccessful testing.

Still another object is to provide novel and advantageous means for and method of permanently connecting housing sections of a gfi receptacle, following complete assembly of all components, releasable coupling of the housing sections, and performance of all required tests.

A still further object is to provide a gfi receptacle including circuit components mounted on a printed circuit board having enhanced reliability of testing after assembly.

Yet another object is to provide a novel method of fabrication of a gfi circuit board which enhances the degree of reliability of tests designed to detect certain manufacturing defects.

Other objects will in part be obvious and in part appear hereinafter.

SUMMARY OF THE INVENTION

The gfi receptacle of the invention includes a plurality of components and subassemblies which may be placed in fully assembled relation by downward, vertical movement in a predetermined sequence. The parts are uniquely configured to permit assembly in this manner by fully automated means, thus eliminating costly manual assembly procedures. The configuration of parts and sequence of assembly also permit electrical connection of certain elements without otherwise required soldering.

Certain subassemblies and individual components are assembled, all by downward, vertical movement, with the printed circuit board after attachment thereto of surface-mount-device (SMD) electrical components. The SMD components include a pair of jumper cables which extend between respective pairs of electrical terminals on the board. One aspect of the assembly method includes breaking continuity of the usual circuit board traces connecting these pairs of terminals prior to surface mounting of the jumper cables on the board. As will be seen, this technique improves the reliability of operational testing of the gfi device.

Following the soldering operation, the circuit board and elements previously assembled therewith are moved vertically downward into the space defined by the rear housing section, the outer, rear surface of which rests on a horizontal support. After downward, vertical movement of several other elements into mutually assembled relation, the front housing section is moved downwardly, being guided into mating relation with the rear section by a plurality of posts on the front section which extend through openings in the rear section.

At termination of its downward movement the front section is releasably attached to the rear section by snap-fit detent means. The reset and test buttons are then assembled by downward, vertical movement into respective openings in the front housing section, and the required electrical tests are performed to ensure proper operation of the device. If any tests indicate unsatisfactory operation, the housing sections may be disengaged and the defective parts replaced or repaired. If the tests indicate proper operation, the housing sections are permanently joined by ultrasonic softening and physical deformation of the portions of the posts on the front section which protrude through the openings in the rear section. This has the effect of providing a mechanical-type, permanent connection of the housing sections, with the deformed ends of the posts being in the nature of rivet heads without requiring separate rivets and a conventional riveting operation.

DETAILED DESCRIPTION

Figure 1:
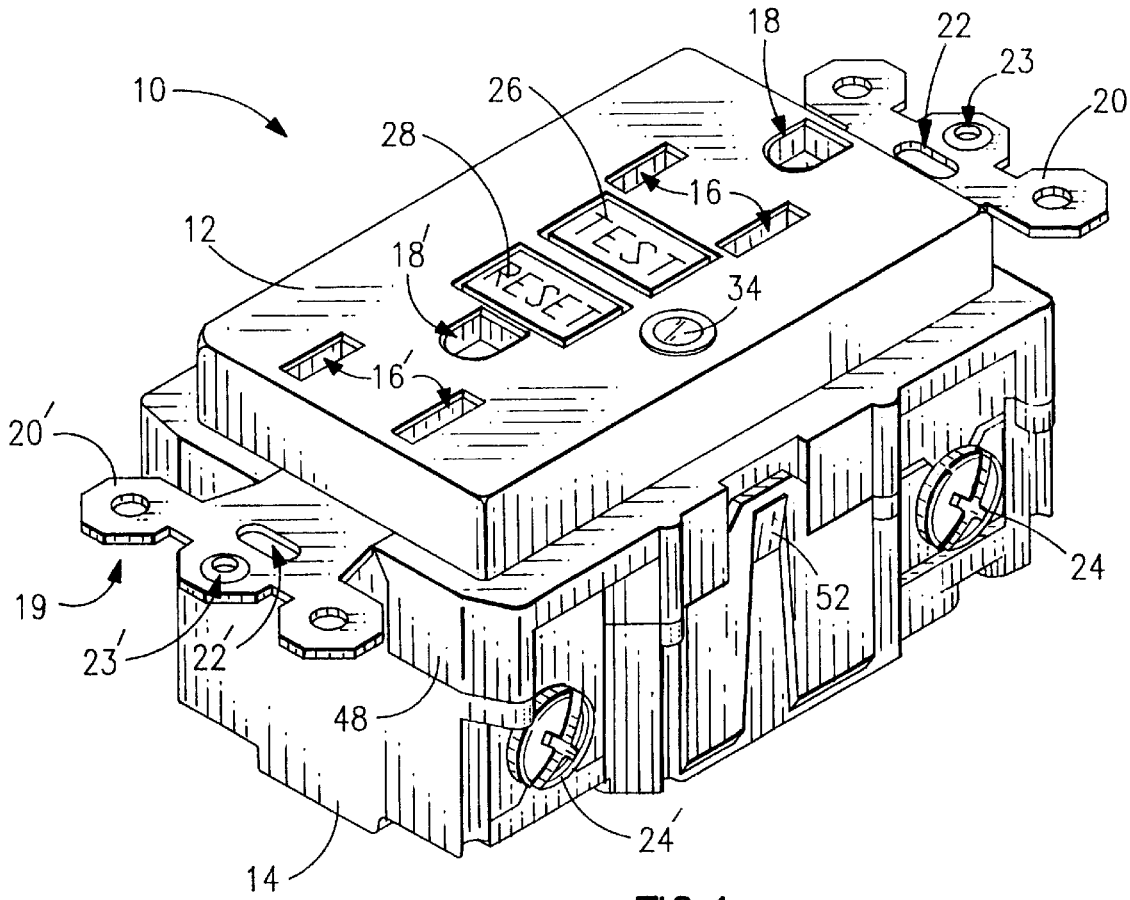
FIG. 1 is a perspective view of a fully assembled ground fault interrupter wiring device, namely, a duplex electrical receptacle, embodying features of the invention.
Figure 2:
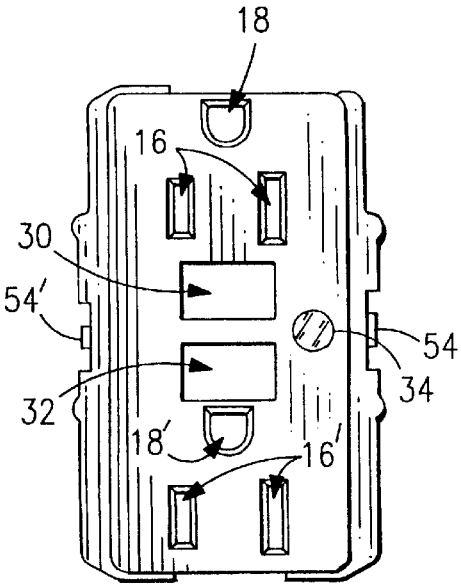
FIG. 2 is a top plan view of the front section or cover of the housing of the receptacle of FIG. 1.

Referring now to the drawings, in FIG. 1 is shown a fully assembled wiring device 10 typical of the class of devices embodying the features of the present invention. Device 10 is a ground fault interrupter (hereinafter abbreviated as "gfi"), duplex, two-pole, electrical receptacle, although it will be understood that certain features of the inventions may be incorporated in other gfi devices, including circuit breaker types requiring only one pole or multiphase devices requiring three or more poles.

As is typical of such devices, components are enclosed in a space defined by housing means comprising a cover or front section 12 and a body or rear section 14. As will later become apparent, the front and rear sections are retained in mutually secured relation by both releasable and permanent securing means. A first pair of through openings 16 is provided in front section 12 to receive a pair of blades of a standard electrical plug, together with a third opening 18 for receiving the ground prong of plugs equipped therewith. A second set of through openings 16', 18' is provided to accept a second plug.

A metal grounding and mounting strap, denoted generally by reference numeral 19, includes a central portion, not seen in FIG. 1, disposed within the enclosed space defined by housing sections 12 and 14, and mounting ears 20, 20' extending outwardly from opposite ends of device 10. Ears 20, 20' include the usual openings 22, 22', respectively, for passage of screws to mount device 10 in a conventional wall box, as well as threaded openings 23, 23' to receive screws for mounting a conventional wall plate (not shown). Also seen in FIG. 1 are a pair of screws 24, 24' for electrical connection of the bare ends of conductors on the line and load sides of the device; as will be seen later, a second pair of screws are provided for connection of conductors on the opposite side of device 10.

A pair of rectangular buttons 26 and 28, labeled "Test" and "Reset", respectively, are positioned in respective, through openings 30 and 32 in front housing section 12. Transparent lens 34 covers an opening in front section 12 for viewing of an operational-indicating LED, as explained later in more detail. Another feature of particular interest in connection with front section 12 is the two rows of four post members each, all indicated by reference numeral 36, extending rearwardly (i.e., in the direction of rear housing section 14 in the assembled condition) along opposite sides of the front section. As will be seen, these post members 36 provide an important function in the final assembly of device 10.

Figure 3:
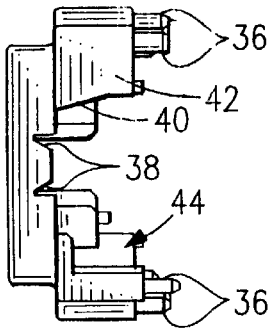
FIGS. 3 and 3*a* are end elevational views of the front housing section, as seen from the top and bottom, respectively, of FIG. 2.
Figure 3A:
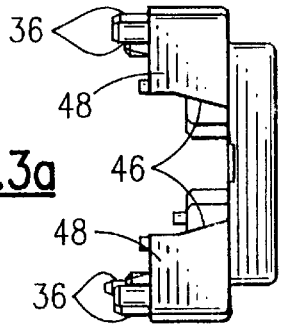
Figure 4:
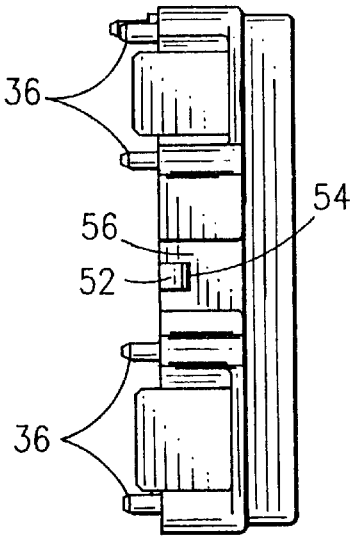
FIG. 4 is a side elevational view of the front housing section, the appearance being the same from both sides.
Figure 5:
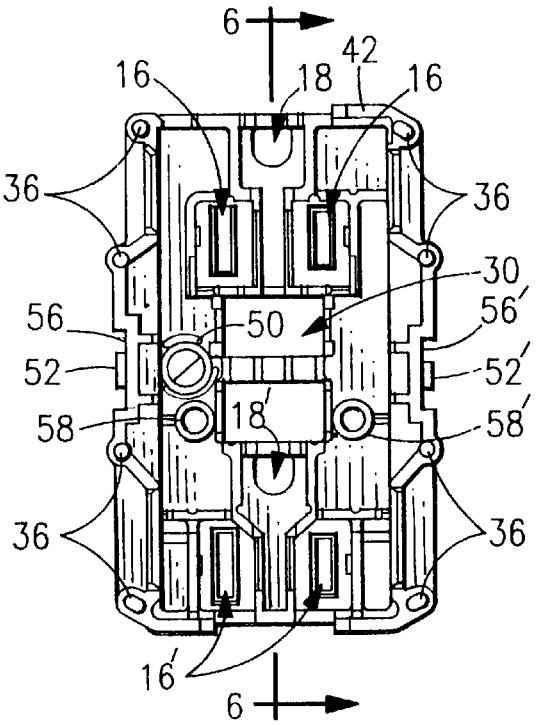
FIG. 5 is a bottom plan view of the front housing section.
Figure 6:
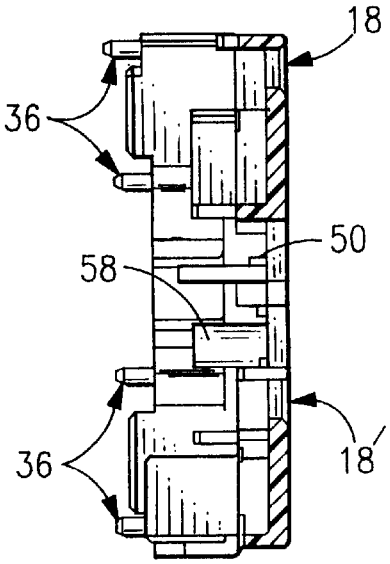
FIG. 6 is a side elevational view in section on the line 6—6 of FIG. 5.
Figure 7:
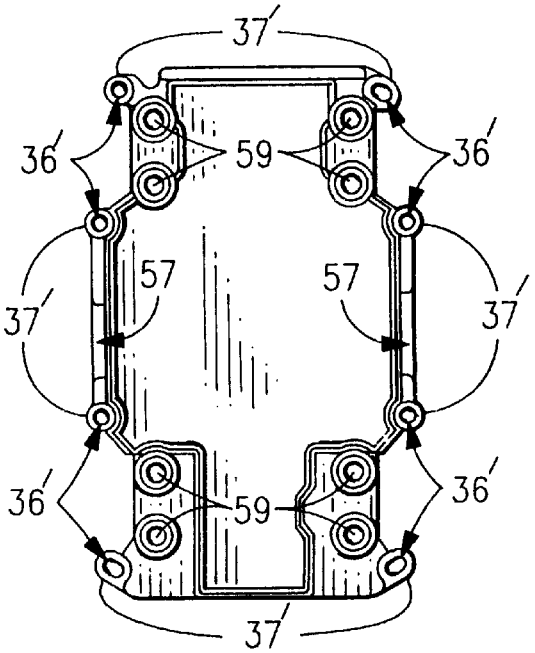
FIG. 7 is a top plan view of the rear section or body of the housing of the receptacle of FIG. 1.

The appearance of front section 12 is similar at its opposite ends, as seen in FIGS. 3 and 3*a*. The upper end, i.e., the end adjacent opening 18, includes a pair of notches 38 for accommodating edges of one of the grounding terminals on the mounting strap. Edge 40 of end wall 42 mates closely with a corresponding end wall edge of rear section 14, and open area 44 provides access to the screw for connecting the bare end of a ground wire to a depending tab on mounting strap 19, as seen later. Edges 46 of wall portions 48 at the lower end mate closely with corresponding edges of rear section 14.

Circular wall portion 50 surrounds the previously mentioned LED in the assembled condition. Tapered lugs 52, 52' extend outwardly from central portions of the outer surfaces on opposite of the front housing section. Lugs 52, 52' provide stepped shoulders 54, 54' and taper inwardly to meet surfaces 56, 56' at the edge which mates with rear section 14. Circular wall portions, termed towers and denoted by reference numerals 58, 58' extend rearwardly from the inside of the front wall of front section 12 to provide abutment means for a pair of coil springs described hereinafter.

Rear housing section 14 is shown in greater detail in FIGS. 7–10. As in the case of front section 12, rear section 14 is preferably formed as a unitary, molded plastic part. The rear or outer surface of rear section 14, i.e., the surface which is exposed in the assembled condition, is seen in FIG.

Figure 10:
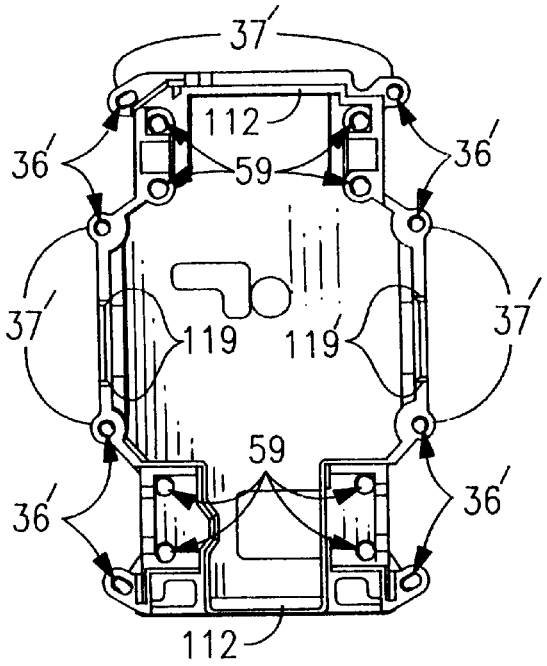
FIG. 10 is a bottom plan view of the rear housing section.

7, and the inner surface, which forms a portion of the enclosed space defined by the assembled housing sections, is seen in FIG. 10. Through openings 36' in portions 37' of rear sections 14 are positioned complementary to posts 36 of front section 12 so that, as the front and rear sections are moved linearly into mating engagement, posts 36 pass through openings 36'. During such relative movement of the housing sections, tapered lugs 52, 52' on front section 12 outwardly deflect resilient tabs 53, 53' on rear section 14 until stepped shoulders 54, 54' on the lugs clear edges 55, 55' of openings 57, 57' in tabs 53, 53'. When this occurs, the natural resilience of tabs 53, 53' causes them to return to their original positions, wherein stepped shoulders 54, 54' abut edges 55, 55' of openings 57, 57'. The housing sections are thus retained in mating engagement by the snap fit means of the lugs and tabs, such engagement being releasable by using a tool to deflect tabs 53, 53' outwardly to permit passage of lugs 52, 52' past edges 55, 55'.

Figure 8:
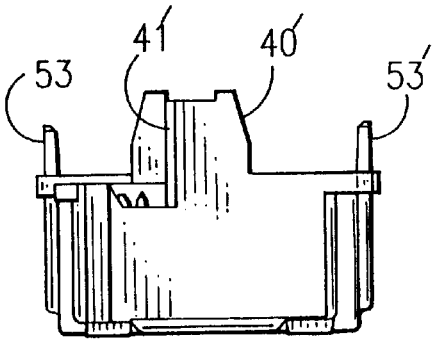
FIGS. 8 and 8*a* are end elevational views of the rear housing section, as seen from the top and bottom, respectively, of FIG. 7.
Figure 8A:
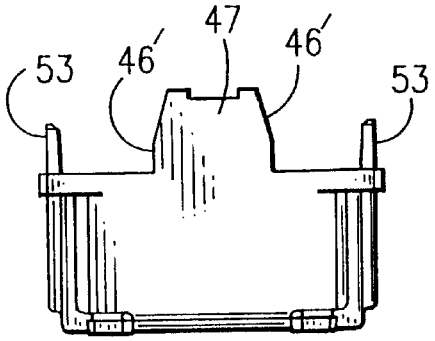
Figure 9:
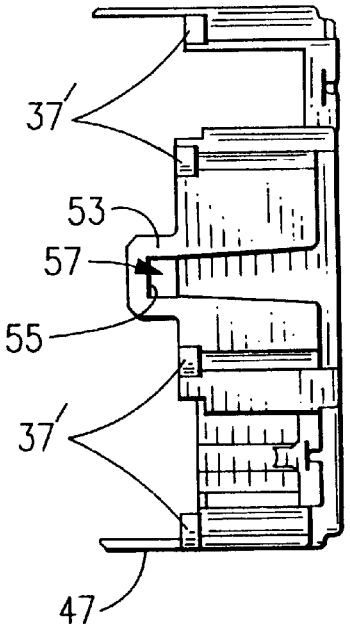
FIG. 9 is a side elevational view of the rear housing section, the appearance being the same from both sides.

When the housing sections are in mutually mating engagement, opposing edges of side and end wall portions thereof abut one another to provide essentially full enclosure of the space wherein the other elements of gfi device 10 are positioned. For example, edge 40 at the upper end of front housing section 12 (FIG. 3) abuts edge 40' of rear section 14 (FIG. 8), and edge 41' borders previously mentioned open area 44. Likewise, edges 46 at the opposite end (FIG. 3*a*) abut edges 46' (FIG. 8*a*) and end wall portion 47 of rear housing section 14 fills the space between these abutting edges. Through openings 59 are provided for passage of the ends of conductors to be connected to terminals within the housing, as explained later.

Figure 11:
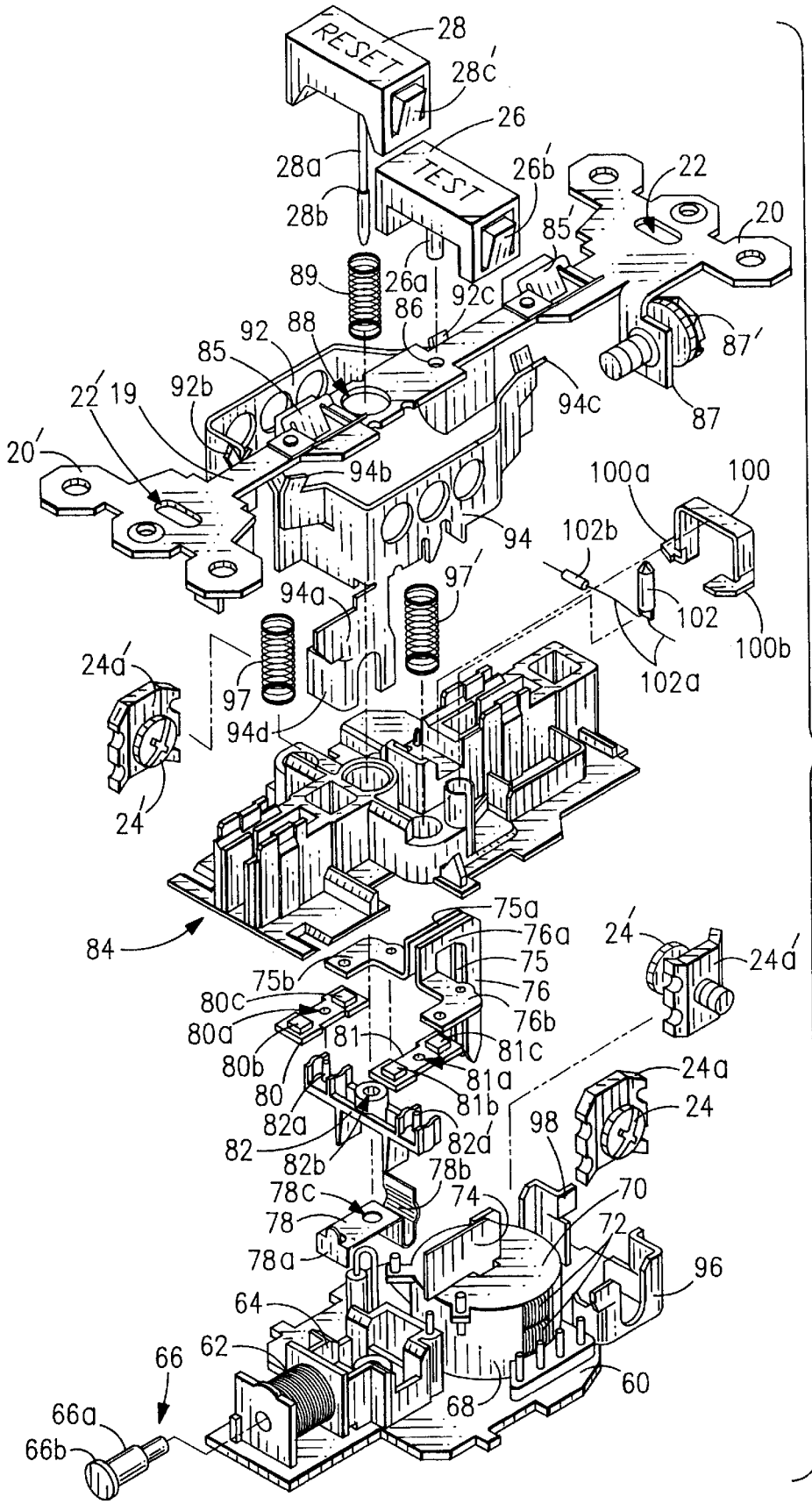
FIG. 11 is an exploded perspective view of components of the GFI device which are configured for automated assembly with the housing sections.

All of the elements which are positioned within the enclosed space defined by housing sections 12 and 14, including the previously mentioned mounting strap 19, test button 26 and reset button 28, are shown in exploded, perspective view in FIG. 11. Further details of construction, assembly and operation of the elements will be provided later herein, but identification of the elements and a general understanding of their interrelationship is facilitated by FIG. 11. Printed circuit board 60 provides a support for solid-state components of the gfi circuitry and includes the usual copper traces interconnecting the components in the required manner. In addition to the electrical and electronic components, certain sub-assemblies are mounted upon board 60.

Solenoid coil 62 is wound on a hollow core portion of plastic support element 64 and stem 66*a* of moveable solenoid armature 66, having enlarged head portion 66*b*, passes loosely through this hollow core. Cylindrical plastic housing 68 and circular plastic cover 70 provide an enclosure for a pair of toroidal cores 72 and associated windings used in sensing an imbalance in current flow through the hot and neutral conductors of device 10 in the usual manner of gfi devices. Wall 74 is formed integrally with cover 70 and provides a dielectric separator for upper portions 75*a*, 76*a* of a pair of conducting posts or strips 75, 76, respectively, which extend through openings in cover 70 and through cores 72. Forward portions 75*b*, 76*b* of strips 75, 76, respectively each carry a fixed contact through which the circuit of the hot and neutral lines is completed. Thus, strips 75 and 76, including their upper and forward portions, form parts of the hot and neutral conductors of the circuit in which gfi device 10 is connected.

Sheet metal member 78, termed a latch spring, has an abutment portion 78*a* at one end, leaf spring 78*b* at the other end, and opening 78*c* in an intermediate portion. When assembled, the U-shaped end of spring 78*b* extends into a cavity of support element 64, and abutment portions 78*a* is positioned for contact by the free end of solenoid armature stem 66*a*. Buss bars 80, 81 are supported on opposite, upper sides of latch block 82 with integral posts 82*a*, 82*a'* of the latch block extending through openings 80*a*, 81*a*, respectively, to provide positive location of the buss bars on the latch block. Buss bar 80 carries spaced contacts 80*b* and 80*c*; buss bar 81 carries spaced contacts 81*b* and 81*c*.

An integral, molded, plastic part, termed a separator and indicated generally by reference numeral 84, includes a plurality of wall portions and openings, the locations and purposes of which are described later. Portions of separator 84 support and laterally constrain mounting strap 19 which is seen in FIG. 11 to include rivet-connected ground contacts 85, 85' for receiving the grounding prongs (extending through openings 18, 18') of electrical plugs connected to device 10. Depending tab 87 has a threaded opening for screw 87' to connect a ground wire to strap 19. Openings 86 and 88 in strap 19 are provided for passage through the strap of pins on test button 26 and reset button 28, respectively. Pin 26*a* is integrally formed in the plastic molding of button 26, and metal pin 28*a*, having shoulder 28*b*, is fixedly secured to the plastic molding of button 28. Coil spring 89 encircles stem 28*a* and has a diameter small enough to pass through opening 88.

Load terminals 92 and 94 are mounted within the housing for connection thereto of the hot and neutral conductors, respectively, on the load side of device 10. Such connection of the neutral conductor may be made to terminal 94 by inserting a bare end of the conductor through either of an appropriate pair of openings 59, and between depending tab 94*a* of terminal 94 and pressure plate 94*a'*; screw 24' passes through an open-ended slot in tab 94*a* and a threaded opening in plate 24*a'*, and is tightened to provide good electrical contact between the conductor and terminal. The hot conductor on the load side is similarly connected to terminal 92 by another screw and pressure plate, not shown in FIG. 11. Such connections are known as "back-wiring". The connections may be alternately made by looping the conductor around the screw between the screw head and the terminal tab. Female contacts 92*b* and 94*b* are positioned to receive the blades of an electrical plug extending through openings 16' in front housing section 12, and contacts 92*c*, 94*c* are positioned to receive the blades of a plug extending through openings 16.

Line terminals 96 and 98 are fixedly connected to circuit board 60 by posts on the terminals extending through openings in the board, and soldered to terminals on the lower side of the board. As best seen with respect to terminal 96, an open-ended slot is provided to receive screw 24, with the head of the screw on one side of the terminal and pressure plate 24*a* on the other side. A bare end of the neutral conductor on the line side of device 10 may be back-wired by inserting through one of openings 59, between plate 24*a* and terminal 96 and tightly urged against the terminal by tightening the screw. The hot conductor on the line side is connected to terminal 98 in like fashion.

Coil springs 97 and 97' pass through respective openings in separator 84 and are compressed between buss bars 80 and 81, and towers 58, 58' on the interior of front housing section 12 when device 10 is fully assembled, as described later. Test blade 100 includes laterally and forwardly extending legs 100*a* and 100*b*, respectively, a medial portion of the blade being positioned for contact by pin 26*a* upon depression of test button 26. LED 102 is positioned within the housing for viewing through previously-mention lens 34; electrical leads 102*a* extend from opposite sides of LED 102, with voltage-dropping resistor 102*b* interposed in one lead, for connection in the circuit in a manner later described.

Figure 12:
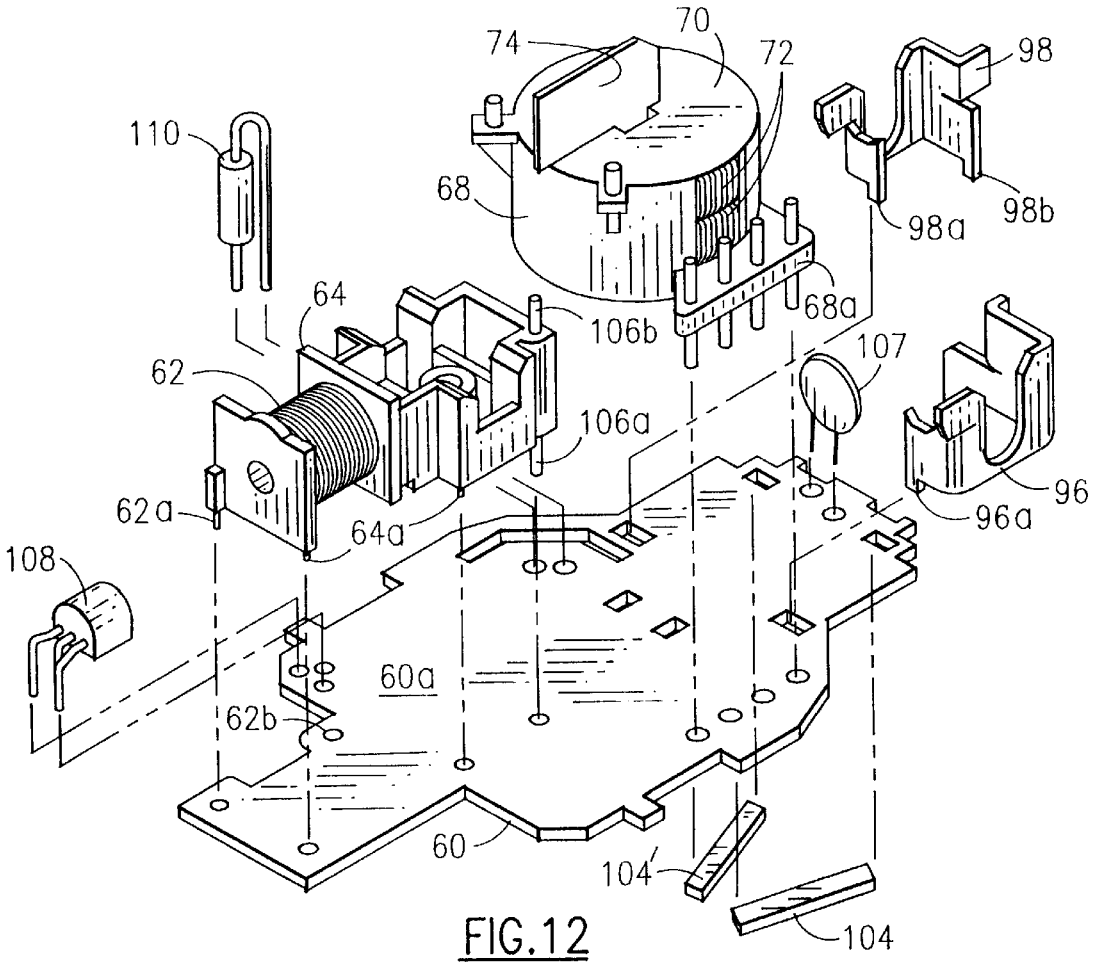
FIG. 12 is a further exploded perspective view of certain of the components shown in FIG. 11.
Figure 13:
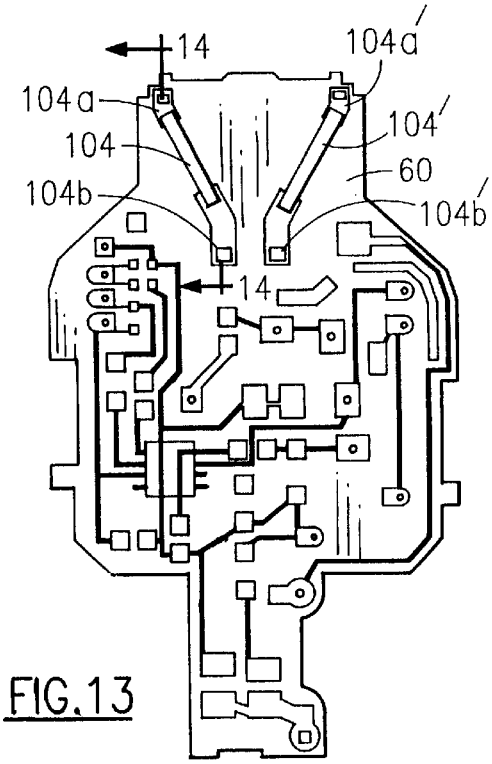
FIG. 13 is a bottom plan view of a printed circuit board, the top of which is seen in FIGS. 11 and 12.
Figure 14A:
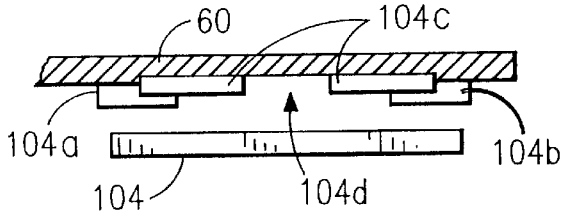
FIGS. 14*a* and 14*b* are fragmentary, enlarged, side elevational views of portions of FIG. 13 illustrating steps in the fabrication of the device.
Figure 14B:
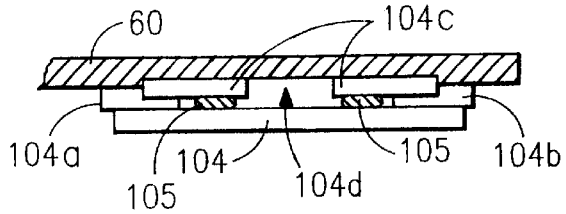

Circuit board 60 and elements mounted thereon are shown in more detail in FIGS. 12–14. Opposite surfaces 60*a* and 60*b* or board 60 are seen in FIGS. 12 and 13, respectively. A plurality of surface-mount-device (SMD) electronic components are attached by a suitable adhesive to surface 60*b* at positions interconnected by preformed copper traces on board 60 to provide portions of the gfi circuitry. Although the circuitry itself is conventional, and therefore not described in detail by way of electrical schematics, or the like, a unique feature is provided by a fabrication technique relating to jumper cables 104, 104' and related portions of the circuit, as shown in FIGS. 14*a* and 14*b*.

Cable 104 connects terminals 104*a* and 104*b*, and cable 104' likewise connects terminals 104*a'* and 104*b'*. Cables 104, 104' are preferably formed by flattening initially round sections of electrical wire on at least one side to provide a flat surface for adhesion to the board by glue dots 105 (FIG. 14*b*). As is the usual practise in construction of circuit boards for gfi devices, terminals 104*a* and 104*b* are connected by a copper trace 104*c*, terminals 104*a'* and 104*b'* being likewise connected. The reason for also connecting these terminals via jumper cables is to carry relatively high currents between these terminals.

In the present gfi device, trace 104*c* and the trace connecting terminals 104*a'* and 104*b'* are broken, as indicated at 104*d*, prior to mounting of jumper cable 104. This provides an important and useful function in testing the circuitry of device 10. Standard operational testing of device 10 is intended to reveal the presence or absence of circuit continuity through the jumper cables, the device being rejected as defective if, for example, one or both cables are inadvertently omitted or defectively connected to the terminals. In conventional devices it is possible that the traces may carry the current for the relatively short interval of testing, thus indicating an operative device even though the jumper cables are omitted or defectively connected. The traces are then likely to be blown out by longer application of higher currents during normal, in-service operation of the device. This problem is obviated by the technique of fabrication of gfi device 10 since only the jumper cables can carry current between the terminals.

One of the ends of the wire of coil 62 is connected to conductive pin 62*a* which extends rigidly from support element 64 through an opening in circuit board 60 for solder connection to the circuit on surface 60*b*. The other end of the coil wire is connected to a conductive pin which is hidden in FIG. 12, but which extends through opening 62*b* in board 60. Short posts 64*a*, integral parts of the plastic molding of element 64, also extend through openings in board 60, as does lower end 106*a* of a conductive pin which is physically incorporated in element 64 during the molding operation and solder-connected in the circuit on surface 60*b*. Upper end 106*b* of this pin extends through separator 84 upon final assembly for contact by test blade leg 100*b* during in-service testing of device 10, as described later.

Integral posts 96*a* and 98*a* extend from line terminals 96 and 98, respectively, through openings in board 60, as does post 98*b* of terminal 98 and a corresponding post (not seen) of terminal 96, the latter posts being solder-connected to respective ends of jumper cables 104, 104'. Block 68*a* is an integral part of the plastic molding which includes cylindrical housing 68. The lower ends of four pins which are molded into block 68*a*, and to which the ends of the windings on cores 72 are respectively connected, extend through openings in board 60 for respective connection on surface 60*b*. The two leads of movister 107, three leads of SCR 108, and the two ends of the conductor carrying resistor 110, likewise extend through openings in board 60 for connection in the circuit on surface 60*b*.

The preferred manner of automated manufacture of device 10 begins with adhesion of the SMD components in their proper positions on surface 60*b*, with this surface facing upwardly. Continuity of trace 104*c* and the trace (not shown) connecting terminals 104*a'* and 104*b'* is broken, as previously described, and SMD jumper cables 104, 104' are adhered by glue dots 105 to surface 60*b*. After sufficient curing of the adhesive, board 60 is mechanically flipped over so that surface 60*a* faces upwardly.

The so-called bobbin and toroid-housing subassemblies are separately fabricated. The bobbin subassembly is prepared by winding coil 62 on the hollow core portion of plastic support element 64, solder-connecting one end of the coil wire to pin 62*a* and the other end to the pin which, after assembly, extends through circuit board opening 62*b*. Armature stem 66*a* is not inserted through the core which is surrounded by coil 62 until later in the operation, as appears hereinafter. Pin 62*a*, the pin to extend through opening 62*b*, and a pin having opposite ends 106*a* and 106*b* are molded or press fitted into plastic support element 64. The toroid-housing subassembly is prepared by inserting pre-wound toroidal cores 72 into housing 68, attaching the ends of the windings to the pins in block 68*a*, placing cover 70 (with integral wall 74) on and affixing it to housing 68, and inserting conducting strips 75, 76 through the openings in cover 70, through toroids 72 in housing 68 and affixing upper portions 75*b*, 76*b* to cover 70 on opposite sides of wall 74 (e.g., by ultrasonic welding of plastic posts extending through openings in portions 75*b*, 76*b* to cover 70).

Figure 17:
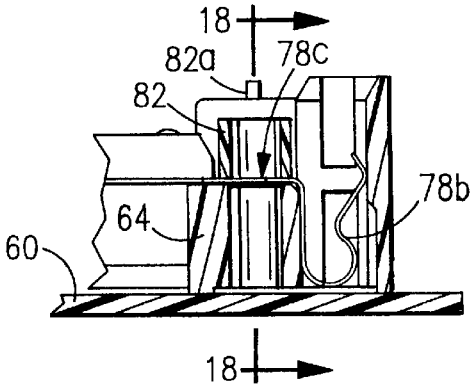
FIG. 17 is an enlarged fragment of FIG. 16.
Figure 18:
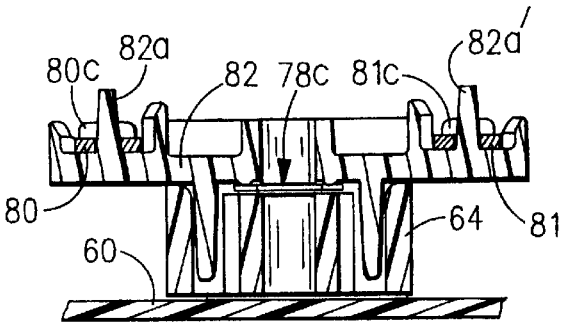
FIG. 18 is an enlarged, fragmentary, elevational view, in section on the line 18—18 of FIG. 17.
Figure 19:
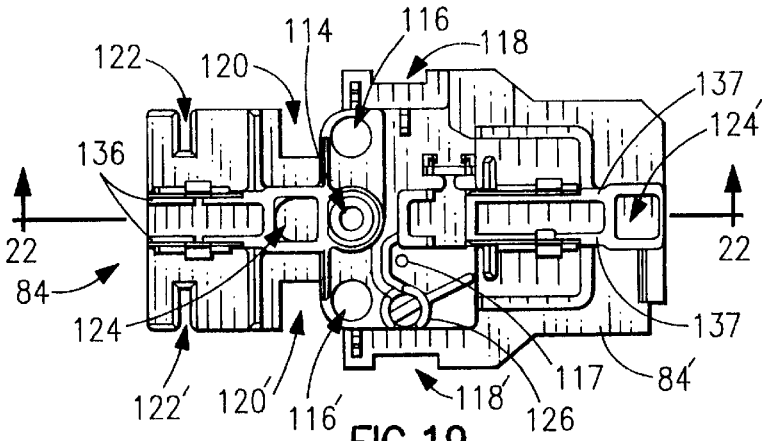
FIG. 19 is a top plan view of a component of the device, termed a separator.
Figure 20:
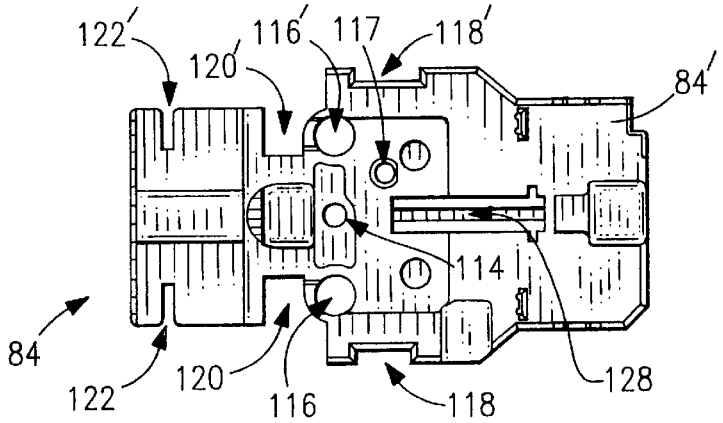
FIG. 20 is a bottom plan view of the separator.
Figure 21:
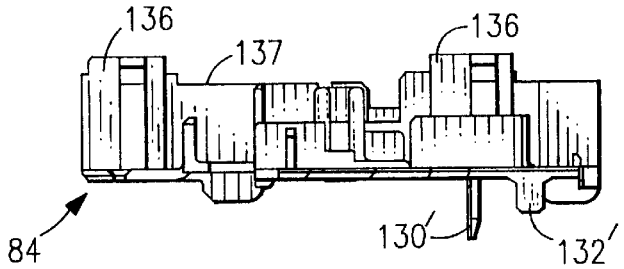
FIG. 21 is a side elevational view of the separator.
Figure 22:
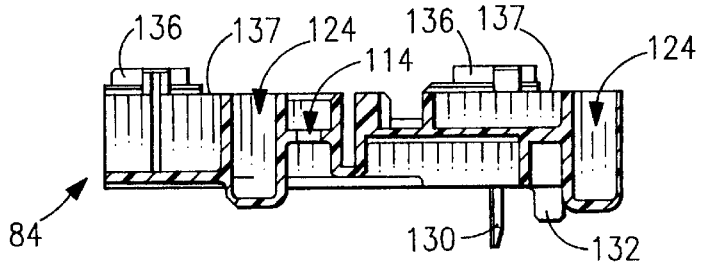
FIG. 22 is a side elevational view in section on the line 22—22 of FIG. 19.

With surface 60*a* facing upwardly, automated assembly proceeds with downward, vertical movement of movistor 107, SCR 108 and resistor 110 (in any desired sequence) to insert the respective leads thereof through the aligned openings in board 60. Armature stem 66*a* is mechanically advanced in a horizontal direction through the plastic core surrounded by coil 62 to complete the bobbin subassembly which is then moved vertically downward to insert posts 64*a*, pin 62*a* and the other coil wire pin, and pin 106*a* through the respective, aligned openings in the circuit board. Latch spring 78, latch block 82 and buss bars 80, 81 are then assembled, in that order, by successive, vertical, downward movement of each into their positions of mutual assembly, best seen in FIGS. 16–18.

The toroid housing subassembly is then moved vertically downward to insert each of the lower ends of conducting strips 75, 76 and the lower ends of the four pins in block 68*a* through aligned openings in circuit board 60. Integral posts 96*a*, 96*b*, 98*a* and 98*b* on line terminals 96, 98 are then inserted through openings in board 60 aligned therewith by vertical, downward movement of the line terminals each carrying one of screws 24 and plates 24*a* in the open slot thereof. This is followed by a soldering operation, connecting all components, leads, pins, terminals, etc. in the required locations on surface 60*b* of board 60.

Figure 15:
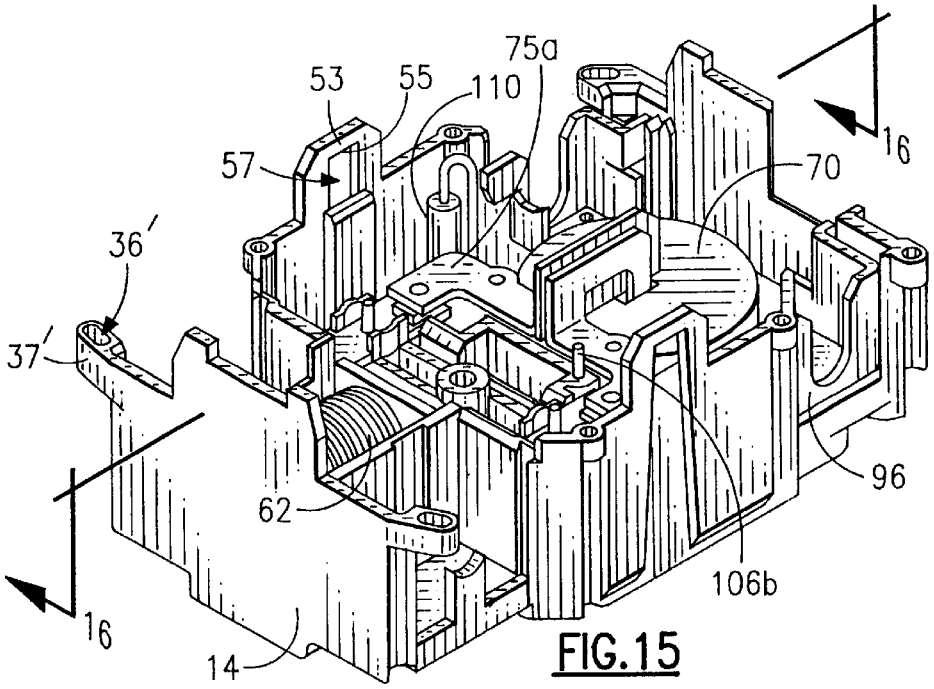
FIG. 15 is a perspective view of the circuit board and components mounted thereon assembled within the rear housing section.
Figure 16:
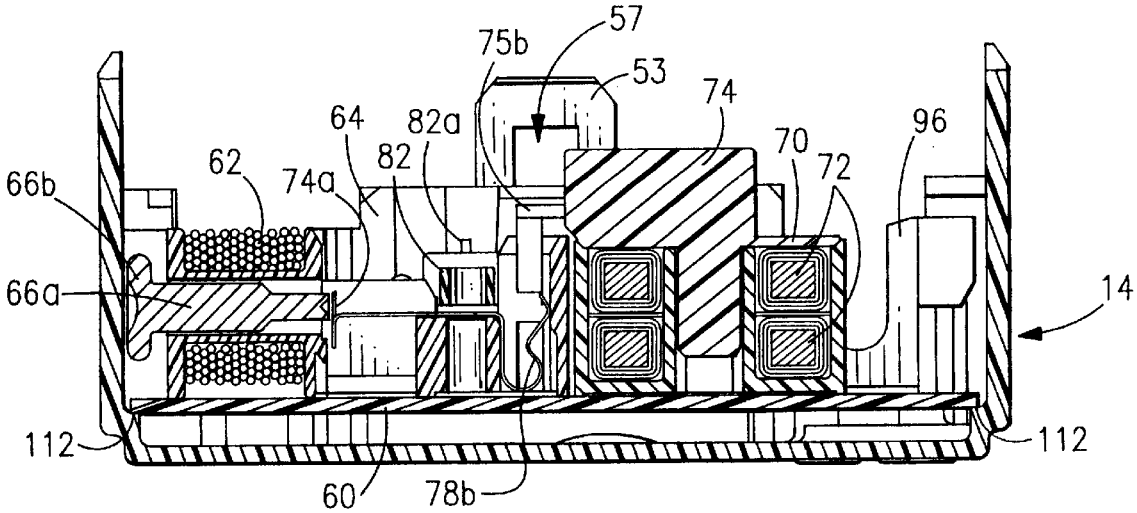
FIG. 16 is a side elevational view in section on the line 16—16 of FIG. 15.

In the next assembly step, rear housing section 14 is placed with its rear (outer) surface facing downwardly, supported on a horizontal surface. Circuit board 60, carrying all of the elements previously assembled as just described, is moved vertically downward, into the space surrounded by the side and end walls of rear section 14, as shown in FIG. 15. The outer periphery of board 60 and the inner periphery of the cavity defined by rear section 14 have complementary configurations to provide close positional constraint of the board. As seen in FIG. 16, edge portions of board 60 are supported on shoulders 112 within housing section 14, providing clearance for the SMD components on surface 60*b*.

Separator 84 is next added to the assembly by vertical, downward movement to position horizontal wall 84' in essentially fully covering relation to the elements previously positioned within rear housing section 14. Details of separator 84 are seen in FIGS. 19–22. Through openings 114, 116 and 116' are mutually aligned on a laterally extending axis of separator 84. Upper end 106*b* of the test pin extends through opening 117 upon placement of the separator. A first pair of slots 118, 118', one on each lateral side of the separator, fit closely around vertically extending shoulders 119, 119' (FIG. 10), respectively, on the interior of rear housing section 14. A second pair 120, 120' and a third pair 122, 122' of separator 84, provide clearances for portions of terminals 92 and 94 during assembly thereof, as explained later. Other, unnumbered wall portions on the upper (FIG. 19) side of separator 84 provides guides and supports for terminals 92 and 94.

Cavities 124, 124' are surrounded by wall portions integral to separator 84 along the longitudinal centerline thereof. Cylindrical wall 126 provides a cavity for placement of LED 102. Longitudinal cavity 128 on the lower (FIG. 20) side of separator 84 accepts the upper portions of contact strips 75, 76 and wall 74. A first pair of tabs 130, 130', one on each lateral side, extend downwardly from wall 84', as does a second pair of tabs 132, 132'. Upon placement of separator 84, tabs 130, 130' extend along and provide support for one side of line terminals 96 and 98, respectively, while tabs 132 and 132' extend into the open, upper ends of the slots in the line terminals to define, together with the closed ends of the slots, essentially circular openings surrounding screws 24. Wall portions 136 extend upwardly on opposite sides of portions of horizontal support surfaces 137.

Figure 25:
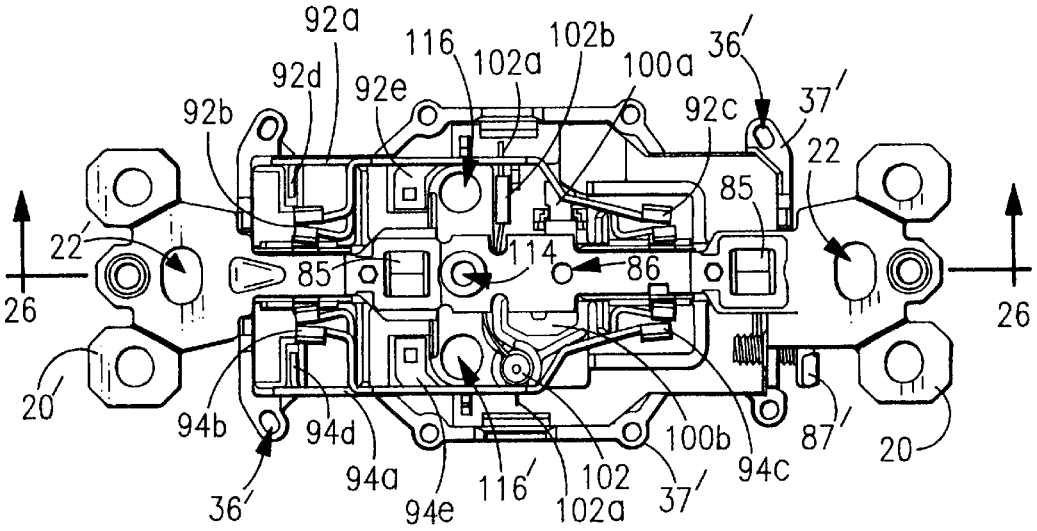
FIG. 25 is a top plan view of the elements as shown in FIG. 24.

With separator 84 in place, LED 102 is moved vertically downward into the cavity defined by wall 126, with leads 102*a* extending laterally outwardly on opposite sides thereof. Test blade 100 is then moved vertically downward into position on separator 84. Load terminals 92 and 94 are next moved vertically downward into assembled relation with the separator and other previously assembled elements. During downward movement of the terminals, arms 92*e* and 94*e* pass through slots 120 and 120', respectively, and tabs 92*d* and 94*d* pass through slots 122 and 122' , respectively, as is evident from FIG. 25. Leads 102*a* are firmly engaged between edge portions of the load terminals and the upper surface of wall surface 84', thereby connecting LED 102 across the load side of device 10 without the need for soldered connections of leads 102*a*. Also, leg 100*a* of test blade 100 is engaged between terminal 92 and wall 84', as appears later.

Figure 23:
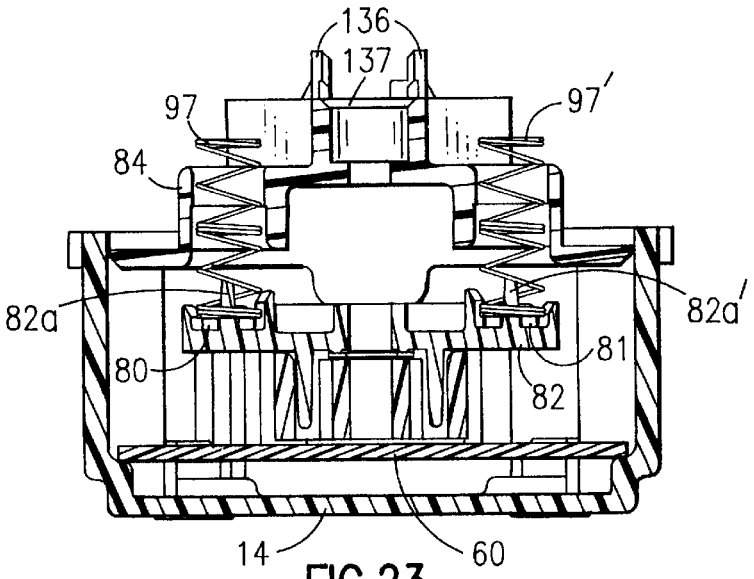
FIG. 23 is an elevational view in section in the position of FIG. 18, with the separator and other elements in assembled relation.

Coil springs 97 and 97' are then moved vertically downward into separator openings 116 and 116', respectively, so that the lower ends of the coils rest upon central portions of buss bars 80 and 81, and surrounding posts 82*a* and 82*a'*, as seen in FIG. 23. The sequence of assembly of load terminals 92, 94 and coil springs 97, 97' may be reversed, if desired.

Figure 24:
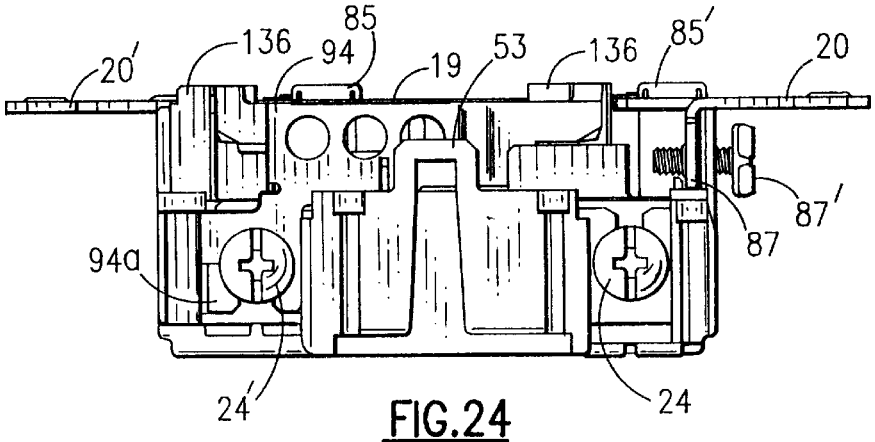
FIG. 24 is a side elevational view, showing further elements in assembled relation.
Figure 26:
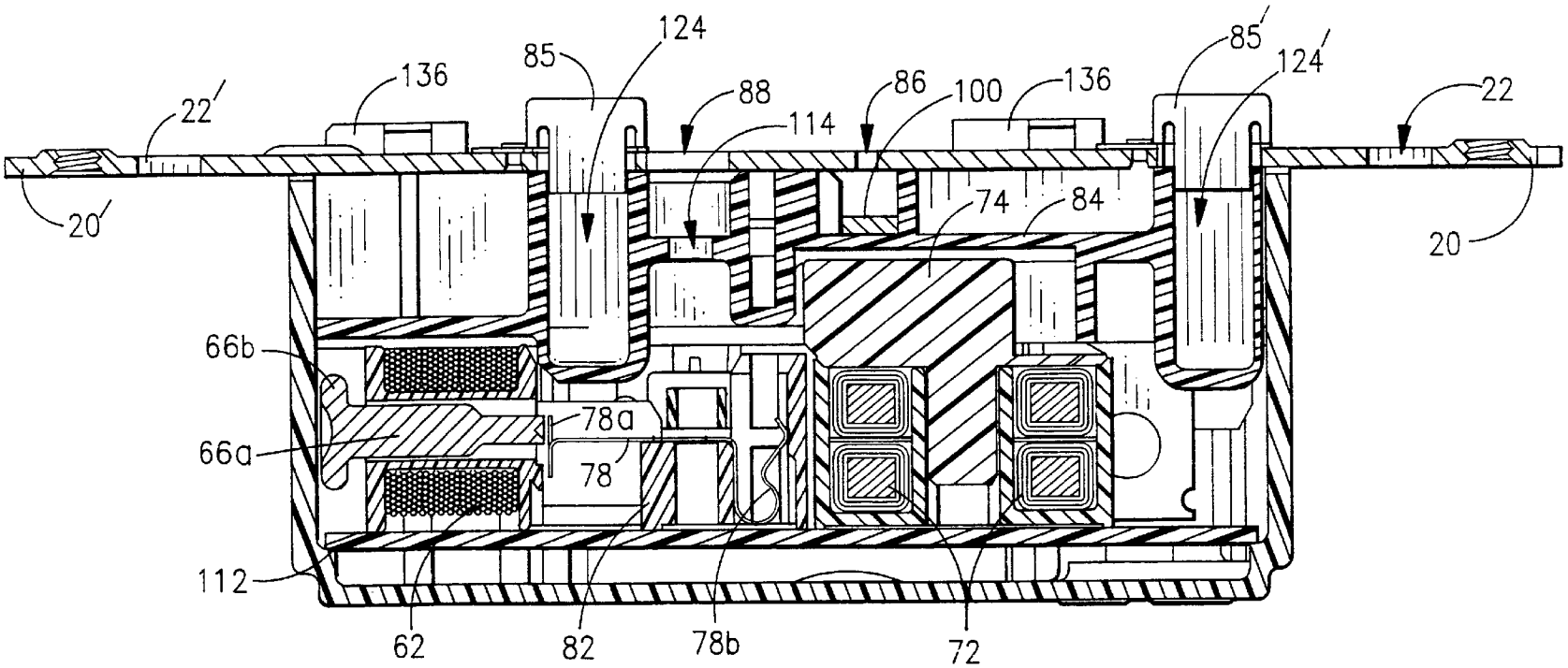
FIG. 26 is a side elevational view in section on the line 26—26 of FIG. 25.

Next, mounting strap 19 is moved vertically downward to rest upon separator support surfaces 137, the strap being laterally constrained by wall portions 136. The elements are now in the positions shown in FIGS. 24, 26, wherein it will be noted that cavities 124 and 124' lie directly beneath ground contacts 85 and 85', respectively, being thus positioned to accept the ground prongs of electrical plugs connected to device 10.

Figure 27:
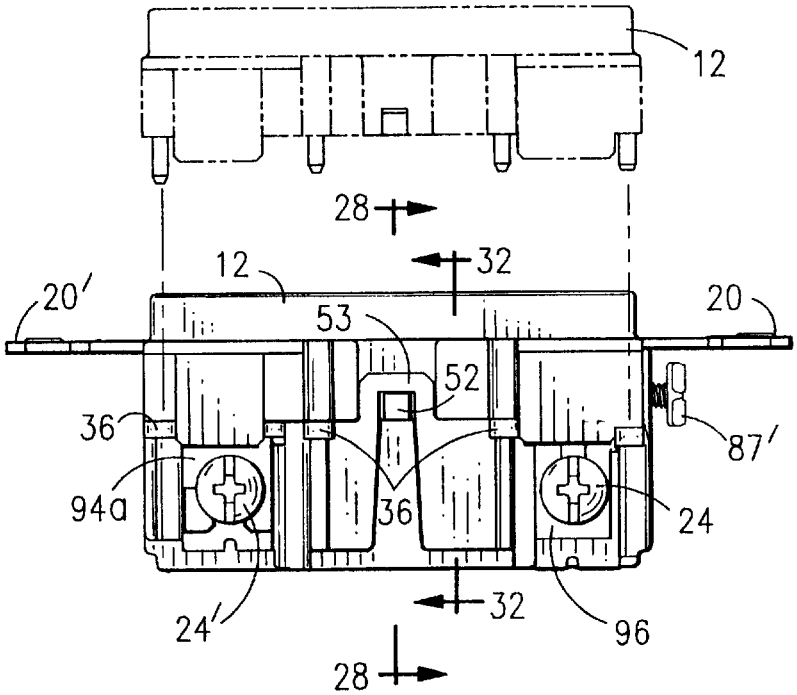
FIG. 27 is a side elevational view showing the manner of assembly of the front housing section with the rear housing section, the latter containing and/or supporting the other components of the receptacle.
Figure 28:
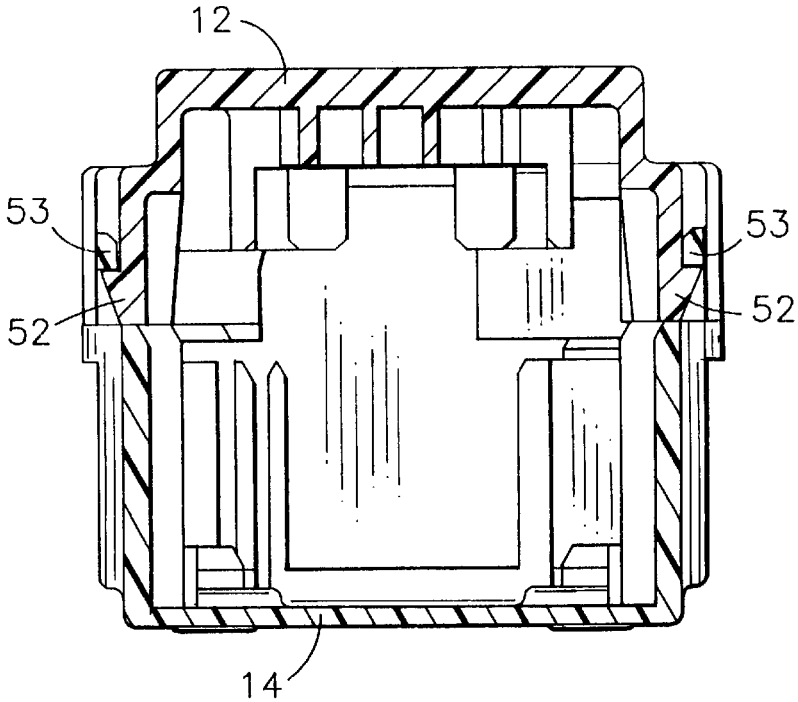
FIG. 28 is an end elevational view in section on the line 28—28 of FIG. 27, illustrating the manner of releasably securing the housing sections in assembled relation.

Front housing section 12 is then positioned above the previously assembled elements, as shown in dotted lines in FIG. 27, and moved vertically downward to the solid line position. During such movement, each of posts 36 passes through a corresponding opening 36', and integral tabs 53 and 53' on rear housing section 14 are deflected outwardly by tapered lugs 52 and 52', respectively, on front section 12. When the front and rear housing sections are fully engaged, they are releasably secured to one another by the snap-fit means of lugs 52, 52' and resilient tabs 53, 53', as previously described. The engagement of lugs 52, 52' under edges 55, 55' of openings 57, 57' of tabs 53, 53' is clearly seen in FIG. 28.

Figure 29:
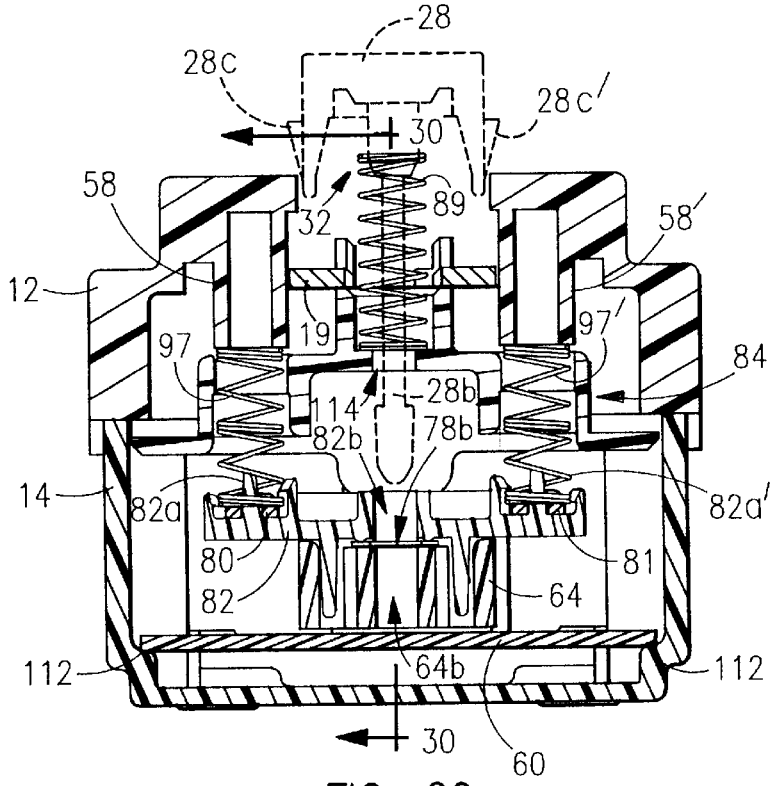
FIG. 29 is an end elevational view in section in the positions of FIGS. 18 and 23 illustrating the manner of assembly of the reset mechanism.

Spring 89 is moved vertically downward along its longitudinal axis, through openings 32 and 88 in front housing section 12 and mounting strap 19, respectively, until its lower end rests upon the portion of separator 84 surrounding opening 114, as seen in FIG. 29. It will also be noted from this Figure that in the mutually assembled relation of the front and rear housing sections, the free ends of towers 58 and 58' bear against the upper ends of coil spring 97 and 97', respectively, thus compressing the springs between fixed towers 58 and 58' at their upper ends and moveable buss bars 80 and 81 at their lower ends.

Reset button 28 is then moved vertically downward to extend stem 28*a* through springs 89, as indicated in dotted lines in FIG. 29. It will be noted from this and other Figures that integral, resilient tabs 28*c*, 28*c'* are positioned in openings in opposite end walls of button 28. Tabs 28*c*, 28*c'* are integral with the end walls of the button along the lower sides of the openings and have outer surfaces which taper outwardly toward the top of the button. The dimensions of button 28, 28*c*, 28*c'* and opening 32 are such that the tabs are deflected inwardly by the edges of the opening as the button is moved downwardly. When the stepped shoulders at the free ends of tabs 28*c* and 28*c'* have cleared the lower edges of opening 32, the natural resilience of the tabs moves them back to their normal, outward positions and button 28 is captured within openings 32.

As reset button 28 is inserted, the free end of stem 28*a*, after passing through spring 89, opening 88 in strap 19, and opening 114 in separator 84, passes through opening 82*b* in latch block 82 and opening 78*c* in latch spring 78, extending into cavity 64*b* of support member 64. Spring 89 biases reset button 28 toward upward movement which is limited by contact of the free ends of tabs 28*c*, 28*c'* with the internal surface portions of housing section 12 adjoining the ends of opening 32.

To place the elements of device 10 in normal operating position, button 28 is manually depressed to move shoulder 28*b* past the edge of latch spring 78 which adjoins opening 78*c*. During this movement, latch spring 78 will be moved slightly toward the right, as viewed in FIG. 30, compressing leaf spring 78*b* within its cavity in support member 64. When shoulder 28*b* moves below latch spring 28, the latter is moved back toward the left by the biasing force of leaf spring 78*b* and the reset button stem is engaged with the latch spring.

Figure 30:
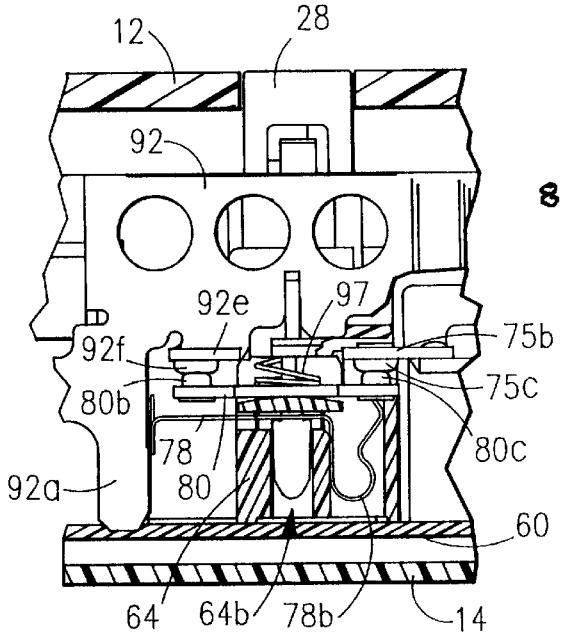
FIGS. 30 and 31 are fragmentary, elevational views in section on the line 30—30 of FIG. 29, showing the positions of the elements with the moveable contacts engaged and disengaged, respectively, with the fixed contacts.

When manual pressure is removed from reset button 28, spring 89 moves the button back in the upward direction. Due to the engagement of shoulder 28*b* with latch spring 78, the latter is also moved upwardly, together with latch block 82 and buss bars 80 and 81. This further compresses coil springs 97 and 97', meaning of course that the biasing force of spring 89 exceeds the combined biasing forces of springs 97 and 97'. Upward movement of the elements places contact 80*b* on buss bar 80 in engagement with contact 92*f* on the lower side of load terminal arm 92*e,* and contact 80*c* in engagement with contact 75*c* on the lower side of portion 75*b* of line contact 75, as shown in FIG. 30. Of course, contacts 81*b* and 81*c* of buss bar 81 are also moved into engagement with corresponding contacts on load terminal 94 and line contact 76. When the contacts are so engaged, the free ends of reset button tabs 28*c* are spaced from (below) the opposing, internal surface portions of front housing section 12. Thus, electrical communication between the line and load sides of device 10 is established for both the hot and neutral conductors through buss bars 80 and 81.

Figure 30A:
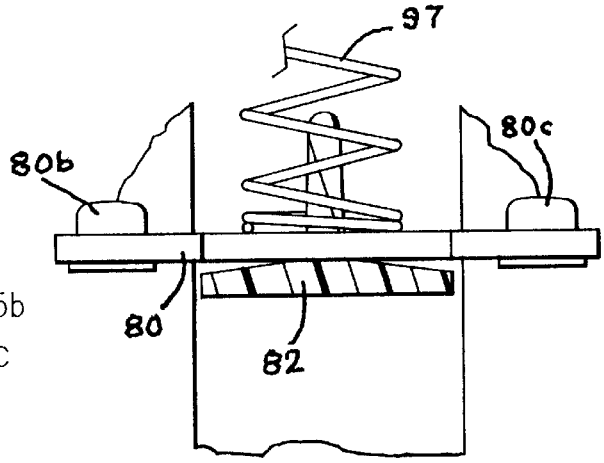
FIG. 30*a* is an enlarged, fragmentary, elevational view in section on the line 30*a*—30*a* of FIG. 29.

FIG. 30*a* illustrates in greater detail the configuration of the upwardly facing surfaces of latch block 82 upon which bias bars 80 and 81 are carried. It will be noted that the surface beneath buss bar 80 slopes downwardly from the center toward each end. Thus, the lower surface of the buss bar is supported essentially only across the mid-point between the positions of contacts 80*b* and 80*c*. This configuration ensures that both of the moveable contacts will be fully engaged with the fixed contacts, compensating for any misalignment which might occur due to opposing planar surfaces being non-parallel.

An imbalance in current flow through the hot and neutral conductors is sensed by toroidal cores 72 and their associated windings. Through the operation of conventional gfi circuitry, the current imbalance energizes coil 62, moving armature 66 and latch spring 78 toward the right. Contact of the free end of stem 66*a* with abutment portion 78*a* moves latch spring 78 to the right, from the position of FIG. 30 to the position of FIG. 31, compressing leaf spring 78 and disengaging the latch spring from shoulder 28*b* on reset button stem 28*a*.

Figure 31:
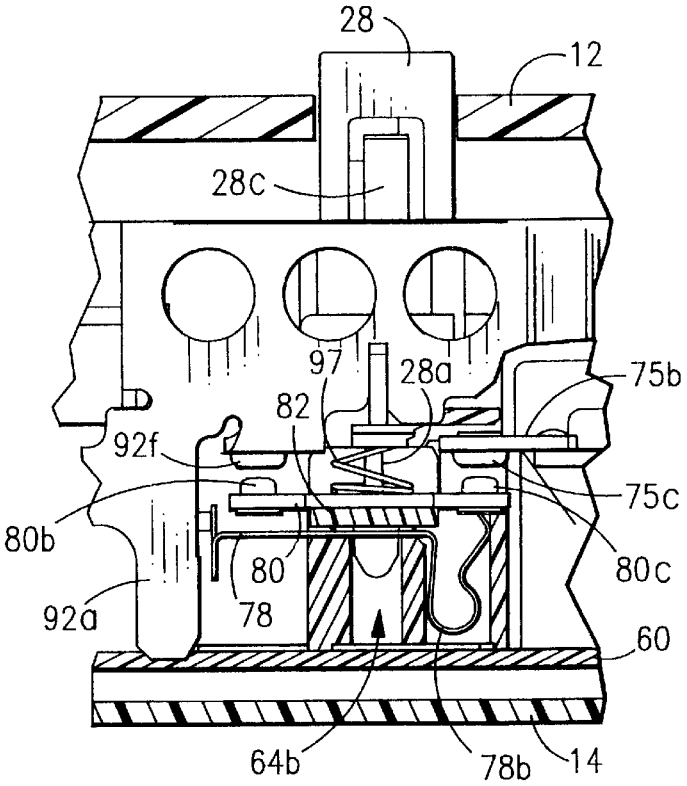

Upon disengagement of latch spring 78 and shoulder 28*b,* spring 89 moves reset button 28 upwardly until the free ends of tabs 28*c* contact internal surface portions of housing section 12 on opposite sides of opening 32. At the same time, the biasing forces of coil springs 97 and 97' move buss bars 80 and 81 downwardly, moving both contacts of both buss bars out of engagement with the corresponding line and load terminal contacts, thereby deenergizing coil 62, allowing armature 66 and latch spring 78 to return to their positions of FIG. 30. As shown in FIG. 31, both contacts 80*b* and 80*c* are spaced from contacts 92*f* and 75*c,* respectively. Thus, circuit continuity between the line and load sides of device 10 is interrupted by a ground fault or other potentially dangerous condition. The elements may be returned to their positions of normal operation by manual depression of reset button 28, as previously explained.

Figure 32:
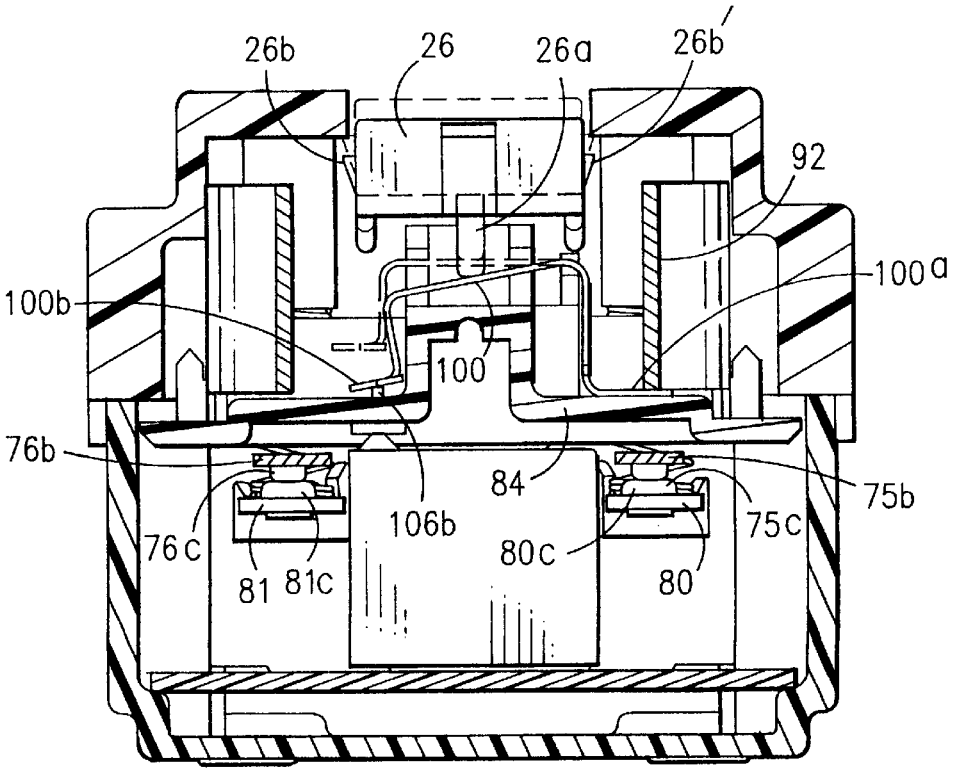
FIG. 32 is an elevational view in section on the line 32—32 of FIG. 27, illustrating the manner of assembly and operation of the test mechanism.

After (or before, if desired) reset button 28 is assembled with device 10, test button 26 is moved vertically downward, into opening 30, as seen in FIG. 32. Resilient tabs 26*b,* 26*b'* in opposite end walls of test button 26 are deflected inwardly as the button is inserted and return to their outer positions to capture the button in opening 30 in essentially the same manner as tabs 28*c,* 28*c'* on reset button 28. Leg 100*a* of blade 100 is firmly engaged between an edge of load terminal 92 and the upper surface of separator wall 84', as previously mentioned.

Blade 100 is constructed of electrically conducting, springy sheet metal in a configuration such that it assumes the position shown in dotted lines in FIG. 32. In this position, a medial portion of blade 100 contacts stem 26*a* and maintains button 26 in its dotted line position, with the free ends of tabs 26*b,* 26*b'* contacting the internal surface portions adjacent the ends of opening 30 in housing section 12. Manual depression of button 26 moves test blade 100 to the solid line position of FIG. 32, bringing leg 100*b* into contact with pin end 106*b* and placing the pin in electrical communication with terminal 92. This has the effect of simulating a fault in the line and, if device 10 is operating properly, results in the previously described operation to interrupt the circuit. Upon removal of manual pressure from test button 26, the parts return to the dotted line positions of FIG. 32 and reset button 28 may be depressed to restore circuit continuity in the manner previously described.

After placement of the reset and test buttons, assembly is complete and device 10 is ready for testing. Such tests are standard in the industry although some variations may be employed. Wires are connected, via the four screws exposed on the exterior of the device, to the hot and neutral terminals on both the line and load sides. The normal operating voltage of the device (e.g., 120 Vac) is applied to the line terminals, first with a fault current slightly below the intended actuating level, and then with a fault current slightly exceeding that level, which should result in non-actuation and actuation, respectively. These tests are repeated at full load, and other tests, e.g., for grounded neutral actuation, noise voltage non-actuation, and acceptable actuating time upon application of a 500 ohm ground fault are also performed.

Figure 33:
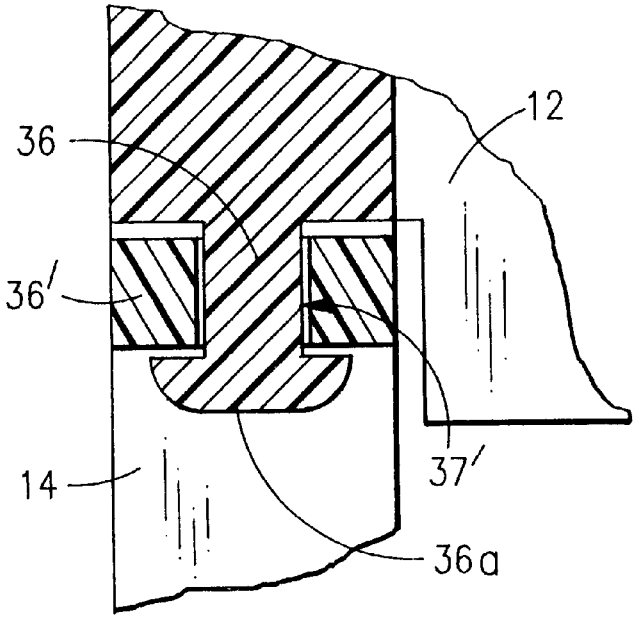
FIG. 33 is a fragmentary, enlarged elevational view, in section, illustrating the manner of permanent connection of the housing sections.

If device 10 fails any of the prescribed tests, it may be disassembled by removing the releasable connection of housing sections 12 and 14 in the manner previously described to repair the defect. If testing is satisfactory, the housing sections are then permanently connected to one another by ultrasonic deformation of the free ends of posts 36 of front section 12 which extend through openings 37' of rear section 14. This has the effect of creating a mechanical, riveted connection between the housing sections with enlarged portion 36*a* acting as a rivet head, as shown in FIG. 33.

Figure 34:
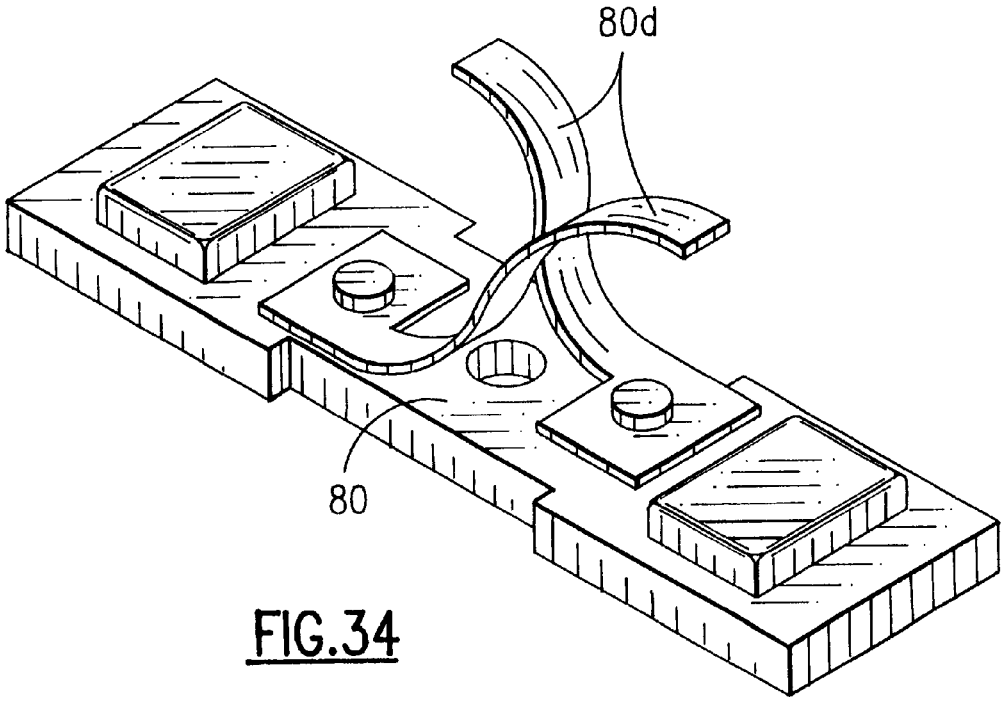
FIGS. 34 and 35 are perspective views of alternate embodiments of certain elements.
Figure 35:
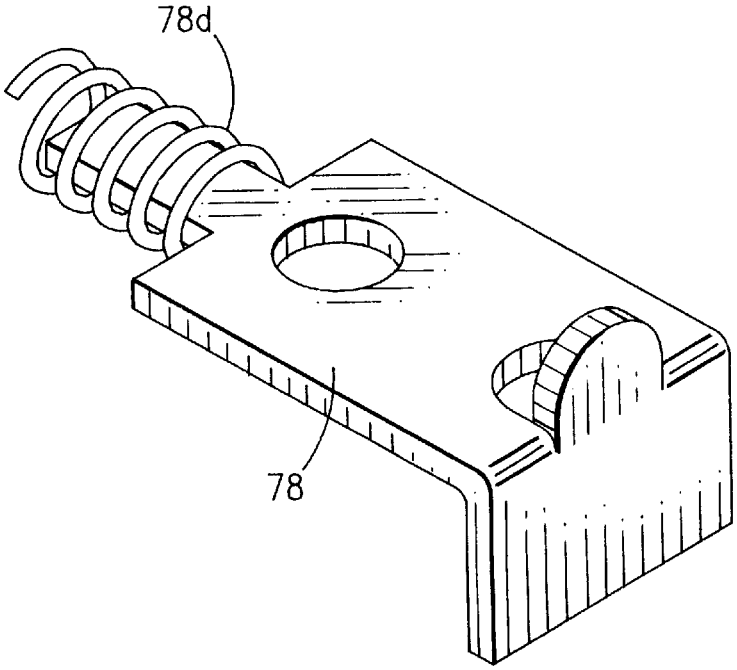
Figure 36:
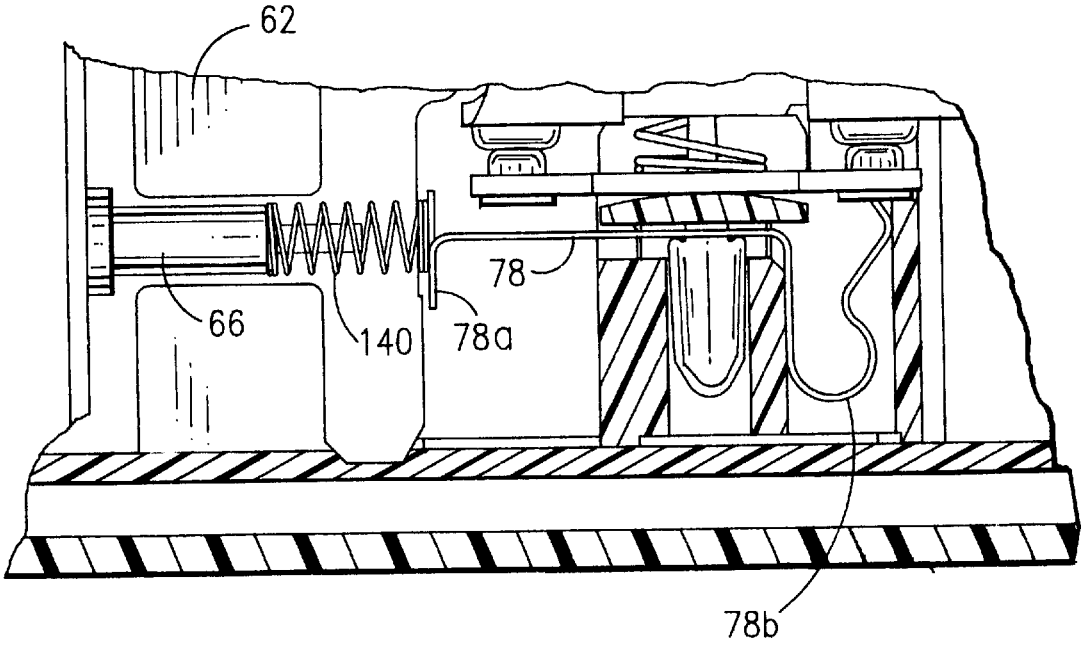
FIG. 36 is a side elevational view of another alternate embodiment.

While the previously described configurations, relative positioning and manner of assembly of the elements represent the presently preferred embodiment, it will be understood that variations in certain details are possible within the scope of the invention. Examples of some of the many possible variations are illustrated in FIGS. 34–36. As shown in FIG. 34, leaf springs 80*d* are attached to (or formed integrally with) buss bar 80. Springs such as leaf springs 80*d* would replace coil springs 97, 97' and provide the biasing force for movement of buss bars 80, 81 to break circuit continuity. FIG. 35 shows an end portion of latch spring 78 carrying coil spring 78*d,* which would replace leaf spring 78*b* and provide the biasing force for latch spring 78. Rather than compressing coil spring 97, 97' (or springs substituted therefor) between the buss bars and interior portions of front housing section 12, such springs could be compressed between the buss bars and portions of the separator. In any case, all parts are so configured that, after separate preparation of bobbin and toroid housing subassemblies, device 10 may be assembled by fully automated means since all parts are placed in assembled relation by downward, vertical movement.

Coil spring 140 is added in the FIG. 36 modification to maintain the terminal end of solenoid armature 66 in spaced relation to abutment portion 78*a* of latch spring 78 when coil 62 is deenergized. All components other than coil spring 140 have the same construction, positional relationships of operation as previously described. Coil spring 140 is weaker than leaf spring 78*b* of latch spring 78 whereby, upon energization of solenoid coil 62, armature 66 moves to compress spring 140 before contacting abutment portion 78*a*. This has the advantageous effect of increasing the momentum of armature 66 prior to contact thereof with the latch spring, thereby improving the circuit-interrupting operation of device 10. Without spring 140, the end of armature 66 may be in contact with abutment portion 78*a* before energization of coil 62, depending upon the physical orientation of device 10. Thus, the improved performance provided by inclusion of spring 140 may offset the increase in cost occasioned thereby.

From the foregoing, it may be seen that the present invention provides a gfi wiring device having components configured for mutual assembly, and a method of assembly of a gfi wiring device, in a manner involving only sequential movement of components and subassemblies along parallel, straight-line paths. Thus, the gfi device and assembly method are eminently suited for employment of fully automated assembly means. The design and operation of such robotic-type, automated assembly means, requiring only parallel, linear movement of parts, is within the purview of those skilled in the art. The invention further provides a gfi device which may be operationally tested after completion of assembly, and methods of assembly and testing, with novel and improved means for permanently connecting initially separate sections of the device housing following successful testing, as well as improving reliability of testing.

What is claimed is:

1. The method of fully automatically assembling a ground fault interrupter (gfi) receptacle including front and rear, matable housing sections having respective, front and rear walls, said front wall including a plurality of through openings for receiving the blades of an electrical plug, said housing sections when in mated relation defining an enclosed space containing a plurality of first components which are fixed with respect to said housing sections and a plurality of second components which are moveable relative to said first components to interrupt an electrical circuit to which said device is connected in response to a circuit fault condition, said method comprising:

a) fabricating each of said housing sections and said first and second components in physical configurations permitting mutual assembly of said first and second components and said housing sections by downward, vertical movement of said components and said front housing section in a predetermined sequence;

b) positioning said rear housing section with said rear wall on a horizontal support; and c) moving said components and said front housing section vertically downwardly in said predetermined sequence relative to one another and to said rear housing section by automated means to complete assembly of said device.

2. The method of claim 1 wherein said first components comprise a printed circuit-board (pcb) with a plurality of solid state devices mounted thereon, said method including the step of surface-mounting and wave-soldering said devices on said pcb.

3. The method of claim 2 wherein said front and rear housing sections are releasably connected to one another upon said moving of said front section.

4. The method of claim 3 and including the further step of performing conventional electrical testing of said device subsequent to said complete assembly.

5. The method of claim 4 and including the further step of permanently connecting said front and rear housing sections to one another subsequent to said testing step.

6. The method of claim 5 wherein said permanently connecting step includes physically deforming portions of one of said housing sections to form a mechanical interference connection with portions of the other of said housing sections.

7. The method of claim 2 wherein said first components include a printed circuit board (pcb) and a support member, said second components include at least one pair of moveable contacts, and said method further comprises assembling a first subassembly by vertical, downward movement of components including said moveable contacts into mating relation with said support member, moving said first subassembly vertically downwardly into mating relation with said pcb, and moving said pcb vertically downwardly into mating relation with said rear housing section.

8. The method of claim 7 and including the further step of winding a solenoid coil upon apportion of said support member.

9. The method of claim 7 wherein said first subassembly includes a latch member, a block member and at least one independent, electrically conducting member with said pair of moveable contacts at spaced positions thereon, and wherein said step of assembling said first subassembly includes moving said latch member vertically downwardly into mating relation with a portion of said support member, moving said block member vertically downwardly into at least partially covering relation to said latch member, and moving said independent member vertically downwardly into mating relation with said block member.

10. The method of claim 2 wherein said second components include a reset member and a test member, and said method includes moving said reset and test members vertically downwardly into said first and second openings, respectively, subsequent to said movement of said front housing section.

11. The method of claim 2 wherein said first components include at least one component having electrical leads for connecting said at least one component in said electrical circuit and a pair of electrical terminals, said method further including moving said at least one component vertically downwardly to place said leads upon underlying, dielectric support means within said enclosed space and thereafter moving said pair of electrical terminals vertically downwardly upon respective ones of said leads, thereby compressing said leads between said terminals and said support means to connect said at least one component in said electrical circuit without physical connection of said leads to other structure.

12. The method of claim 11 wherein said at least one component is an element providing a visual indication of the operational status of said gfi device.

* * * * *

UNITED STATES PATENT AND TRADEMARK OFFICE

CERTIFICATE OF CORRECTION

PATENT NO. : 6,199,264 B1
DATED : March 13, 2001
INVENTOR(S) : Marcou et al.

It is certified that error appears in the above-identified patent and that said Letters Patent is hereby corrected as shown below:

Title page,
Item [75], Inventors, Jean-Claude Marcou, DeWitt;
Thomas N. Packard, Syracuse;
and Patrick J. Murphy, Marcellus,
all of NY (US)

Signed and Sealed this

Twenty-ninth Day of January, 2002

*Attest:*

*Attesting Officer*

JAMES E. ROGAN
*Director of the United States Patent and Trademark Office*